US005379896A

United States Patent [19]

Snow et al.

[11] Patent Number: 5,379,896

[45] Date of Patent: Jan. 10, 1995

[54] DISPLAY CONTAINER WITH RECLOSABLE TOP FOR WINDSHIELD WIPERS

[75] Inventors: Gary L. Snow, Rock Falls; Michael L. Getzendaner, Polo, both of Ill.

[73] Assignee: Stant Corporation, Deerfield, Ill.

[21] Appl. No.: 32,782

[22] Filed: Mar. 17, 1993

[51] Int. Cl.[6] ..... B65D 73/00

[52] U.S. Cl. ..... 206/470; 206/467

[58] Field of Search ..... 206/470, 467, 462, 461

[56] References Cited

U.S. PATENT DOCUMENTS

| | | | |
|---|---|---|---|
| D. 92,775 | 7/1934 | Sekine . | |
| D. 242,326 | 11/1976 | Thorman . | |
| D. 267,544 | 1/1983 | Neto et al. . | |
| D. 288,907 | 3/1987 | Crawford . | |
| D. 289,014 | 3/1987 | Crawford . | |
| D. 295,832 | 5/1988 | Shelton . | |
| D. 316,673 | 5/1991 | Rysner et al. . | |
| D. 327,013 | 6/1992 | Reighart . | |
| 1,180,618 | 4/1916 | Stirn | 206/462 X |
| 2,026,626 | 1/1937 | Gilfillan . | |
| 2,796,985 | 6/1957 | Gorton . | |
| 3,089,590 | 5/1963 | Mell | 206/467 |
| 3,217,867 | 11/1965 | Harris . | |
| 3,327,843 | 6/1967 | O'Meara et al. . | |
| 3,448,853 | 6/1969 | Repko | 206/470 |
| 3,529,718 | 9/1970 | Zaremski . | |
| 3,581,885 | 6/1971 | Wald | 206/470 |
| 4,106,615 | 8/1978 | Hiroshi . | |
| 4,180,165 | 12/1979 | Kuchenbecker . | |
| 4,184,597 | 1/1980 | Gavin . | |
| 4,239,104 | 12/1980 | Roccaforte et al. . | |
| 4,266,666 | 5/1981 | Kuchenbecker | 206/461 |
| 4,279,376 | 7/1981 | Roccaforte et al. . | |
| 4,291,807 | 9/1981 | Giordano et al. | 206/470 X |
| 4,355,578 | 10/1982 | Lavery . | |
| 4,378,903 | 4/1983 | Sherwood . | |
| 4,619,364 | 10/1986 | Czopor, Jr. | 206/470 X |
| 4,739,353 | 4/1988 | Heuer et al. . | |
| 4,842,141 | 6/1989 | Segal . | |
| 4,854,450 | 8/1989 | Fisher . | |
| 4,895,255 | 1/1990 | Fisher . | |
| 4,962,849 | 10/1990 | Anderson . | |
| 5,002,187 | 3/1991 | Rysner et al. . | |
| 5,027,947 | 7/1991 | Reighart . | |
| 5,038,944 | 8/1991 | Sorrenson et al. . | |
| 5,046,616 | 9/1991 | Makowski et al. | 206/470 X |
| 5,133,454 | 7/1992 | Hammer | 206/470 X |

FOREIGN PATENT DOCUMENTS

| | | |
|---|---|---|
| 2729808 | 1/1979 | Germany . |
| 1384547 | 2/1975 | United Kingdom . |

OTHER PUBLICATIONS

ROBERK All-Weather Wiper Blade Container, Epicor Industries, Inc. (1988).

TRIPLEDGE Windshield Wiper Container, Lifetime Automotive Products (1991).

LEXOR Windshield Wiper Container, Pylon Manufacturing (date unknown).

ANCO Aero Vantage Wiper Container, Cooper Industries, (1991).

*Primary Examiner*—Paul T. Sewell
*Assistant Examiner*—Ted Kavanaugh
*Attorney, Agent, or Firm*—Allegretti & Witcoff, Ltd.

[57] ABSTRACT

A windshield wiper display container is disclosed which has a blister with an open top and a reclosable flap serving to close the open top of a blister. The flap has a pressure sensitive adhesive applied to its lower surface which acts to releasably seal the flap to the front wall of the blister. The user opens the container by lifting up on the flap and folding it up to expose the windshield wiper within the blister.

12 Claims, 2 Drawing Sheets

DISPLAY CONTAINER WITH RECLOSABLE TOP FOR WINDSHIELD WIPERS

BACKGROUND OF THE INVENTION

A. Field of the Invention

This invention relates to the field of display containers for windshield wiper assemblies.

B. Background Art

A primary purpose or objective of the display container is to present an attractive medium for presenting the windshield wiper to the consumer. Display containers for windshield wipers typically house the wiper within a clear plastic blister to allow the consumer to view the wiper assembly itself before purchase. Ideally, the display container should also be a reclosable package. Moreover, the display package should not damage the wiper blade during transport or storage of the package and wiper. To understand further these characteristics of a preferred windshield wiper container, some discussion of the peculiarities of windshield wipers and the circumstances surrounding their sale is appropriate.

Windshield wipers are mainly sold as an after-market replacement part in auto supply stores, service stations, and other retail outlets. Because the original equipment wiper and wiper arm specifications for each car manufacturer vary from manufacturer to manufacturer, the consumer's task of finding the correct replacement windshield wiper assembly for their particular make, model, and year of car, is formidable. Indeed, frequently the consumer purchases the wrong windshield wiper assembly, but only realizes this after opening the windshield wiper display package and unsuccessfully attempting to install the wiper assembly. When the display package for the windshield wiper assembly is not a reclosable package (as is the often the case), the opening of the package involves the mutilation or complete destruction of the package. When the customer returns the mutilated package to the store along with the wiper assembly for a refund, the store has on its hands an essentially unsalable product, as future customers at the store pass over the mutilated packages (sometimes crudely repaired) when selecting windshield wipers for purchase. In the aggregate, this problem of packaging of windshield wipers is of considerable importance to the automotive after-market parts industry. The present display container for windshield wipers overcomes this problem.

One reclosable windshield wiper display package in the prior art is disclosed in U.S. Pat. No. 5,027,947, issued to Reighart. In this package, the backing strip for a blister only partially covers the back of the blister. A removable sleeve slides over the top end of the blister and covers the open portion of the back of the blister. By removal of the sleeve, the wiper is exposed through the open back portion of the blister, permitting easy removal of the wiper from the blister. This design is a relatively cumbersome and expensive design, in that it requires the manufacture and assembly of two parts instead of one.

Display packages for windshield wipers present other challenges which have not been satisfactorily recognized or solved by the prior art. Windshield wipers are typically displayed for fairly long periods of time in a vertical orientation. Frequently, wipers are also shipped and stored in a vertical orientation as well. When a windshield wiper is simply placed in a plastic blister package and stored and displayed in a vertical orientation, as is common in the industry, the lower region of the elastic wiping element of the wiper assembly is pressed into contact with interior surface of the blister. Due to the resilient nature of the wiping element, the edge of the wiping element becomes deformed from a strait wiping edge. When the wiper is positioned for weeks or months in such a condition, the edge of the wiping element typically takes on a set, or permanent configuration, according to the shape it was deformed into. This set can greatly reduce the wiping performance of the windshield wiper once installed on an automobile.

The consumer understandably blames the poor performance of the windshield wiper on the wiper element, but often the real problem is not the wiper at all, but rather the display container for the windshield wiper. This problem has been largely unrecognized by the prior art. For example, U.S. Pat. No. 4,895,255, issued to Fisher, is directed to a method of bundling and shipping of windshield wiper containers, and recognizes that windshield wipers are stored in a vertical orientation. However, the Fisher patent does not address the wiper set problem. Moreover, the Reighart patent discussed above also does not address the wiper set problem. However, we have recognized this problem and provide a novel and effective solution to this problem.

SUMMARY OF THE INVENTION

The present invention is a display container for windshield wiper assemblies in which a blister suitable for accommodating a windshield wiper is provided which covers a backing strip. The blister has a front wall and first and second sidewalls forming the body for containing the windshield wiper. The blister has a open top through which the windshield wiper is inserted and retracted. A reclosable flap structure is provided for closing the open top of the blister. The flap comprises, in the preferred embodiment, a cardstock header, a shelf portion covering the open top, and a tongue portion covering the front wall of the blister which releasably engages the front wall of the blister. Preferably, an adhesive is applied to the lower surface of the tongue such that the tongue releasably adheres to the front wall. When the tongue is lifted up and away from the front wall, the tongue can be folded out of the way to expose the open top of the blister, thereby exposing the windshield wiper to the consumer and allowing the windshield wiper to be inserted and extracted from the display container without damage to the container.

In another aspect of the invention, a holding means for holding the windshield wiper assembly away from the interior surface of the blister is provided. The blister includes a lower corner region having concave and lateral edge walls which define a recess. The recess is sized and formed to accommodate the extreme lateral end of a windshield wiper assembly superstructure. The extreme lateral end of a windshield wiper assembly superstructure in is accommodated in the recess or pocket such that the resilient windshield wiper element of the assembly is maintained in a position isolated from the interior surface of the blister.

An object of an invention is to provide a reclosable windshield wiper display container which permits the consumer to remove the windshield wiper assembly from the display without mutilation or damage to the display container.

A further object of the invention is to provide a windshield wiper display container which includes features for preventing a windshield wiper blade or wiping element from taking on a set if the windshield wiper is displayed or stored in a vertical orientation for a substantial period of time.

A further object of the invention is to provide a windshield wiper assembly which is relatively easy to manufacture in large quantities at relatively low costs. Moreover, the windshield wiper display container of the present invention is easy to use and attractive in appearance.

These and other aspects of the invention will be more readily understood by reference to the following detailed description of the preferred embodiment of the invention and the appended drawings.

BRIEF DESCRIPTION OF THE DRAWINGS

There is illustrated in the drawings presently preferred embodiments of the invention, wherein like reference numerals refer to like elements in the various views, and wherein.

DETAILED DESCRIPTION OF THE PREFERRED EMBODIMENT

Figure 1:
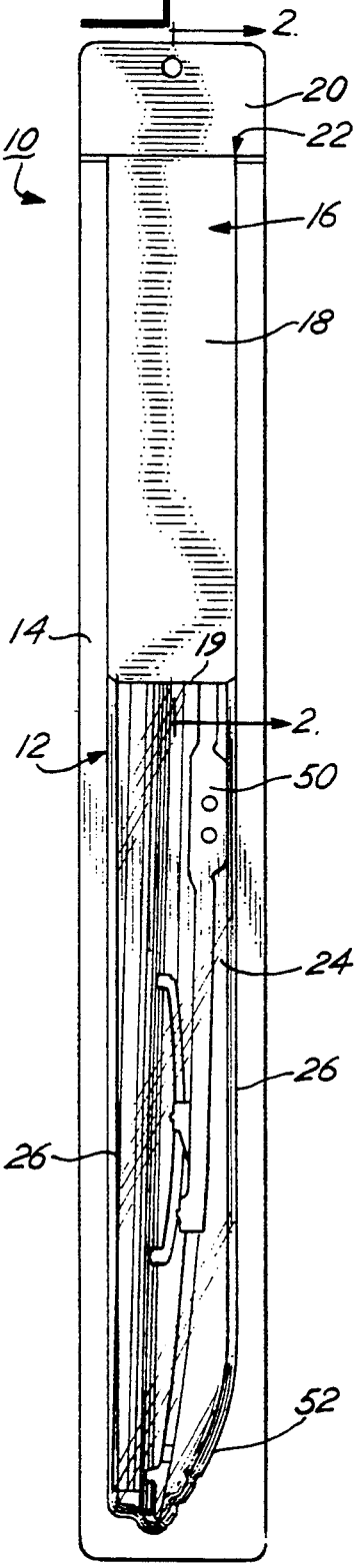
FIG. 1 is a front elevational view of our display container with the flap in a closed condition.
Figure 2:
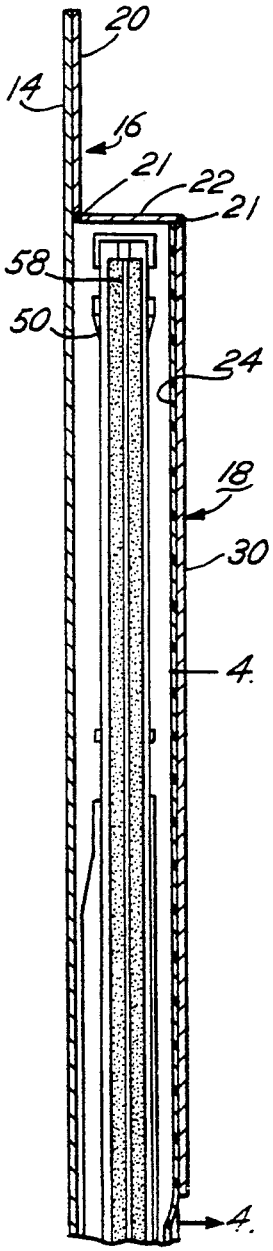
FIG. 2 is a fragmentary, cross-sectional side view of the top portion of the container of FIG. 1 along the lines 2—2 of FIG. 1 showing the flap in a closed condition.

Referring now to the Figures, there is shown presently preferred embodiments of the invention in which the display container 10 is shown as having a clear plastic blister 12 sealed to a cardstock or plastic backing strip 14. The blister 12 has a front wall 24 and two side walls 26 forming a vessel in which to contain a windshield wiper assembly 50. The container 10 has a cardstock flap structure 16 for closing the open top 28 (FIG. 3) of the blister 12. As best seen in FIGS. 1 and 2, the flap structure 16 comprises a header portion 20 sealed to the top of the backing strip 14, a shelf or blister closing portion 22 horizontally disposed over the open top 28 of the blister 12, and a downwardly depending tongue or strip portion 18 covering the front wall 24 of the blister 12. As shown in FIG. 2, a score line 21 is provided in the cardstock flap structure 16 between the header portion 20 and the blister closing portion 22, and between the blister closing portion 22 and the tongue 18. The score lines 21 facilitate the easy folding back of the tongue 18 and the blister closing portion 22 when the tongue 18 is lifted up, as shown in FIG. 3, so as to expose the open top 28 to extract the windshield wiper assembly 50.

Figure 3:
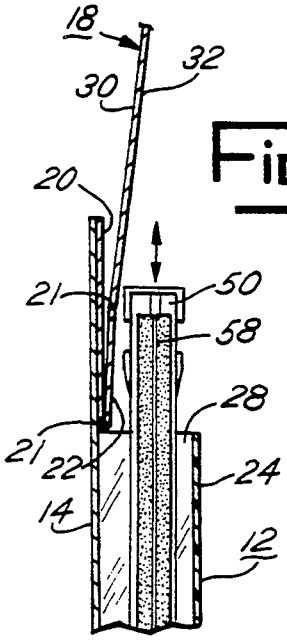
FIG. 3 is a fragmentary, cross-sectional side view of the top portion of the container of FIG. 1 showing the flap in an open condition.
Figure 4:
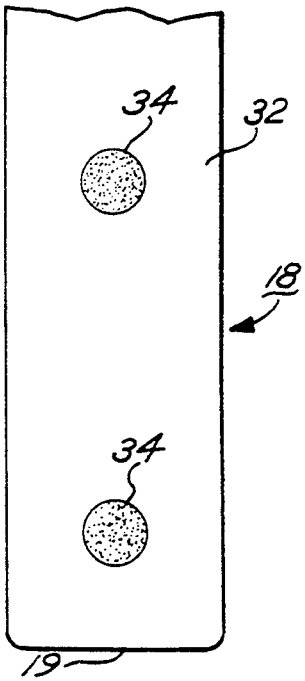
FIG. 4 is a plan view of the lower surface of the tongue portion of the flap of FIG. 1, showing the position of adhesives which are applied to the lower surface of the tongue.

Referring now to FIGS. 3 and 4 in particular, the tongue element 18 is provided with upper and lower surfaces 30 and 32, respectively. The lower surface 32 lays adjacent to the front wall 24 of the blister 12 when the flap structure 16 is in a closed condition. To keep the flap structure 16 closed and to prevent accidental removal of the wiper assembly 50 from the container 10 during transit or handling, the lower surface 32 of the toungue 18 has a pressure sensitive adhesive applied to the lower surface 32. As shown in FIG. 4, a plan view of the lower region of the tongue 18, two regions 34 of adhesive, applied several inches apart, has been found to satisfactorily close the tongue 18 against the blister 12. Nevertheless, other types of adhesives and other placements of adhesive may of course be chosen. Moreover, the adhesive may be applied to the front wall 24 of the blister instead of the tongue 18, as shown in FIG. 4.

Figure 5:
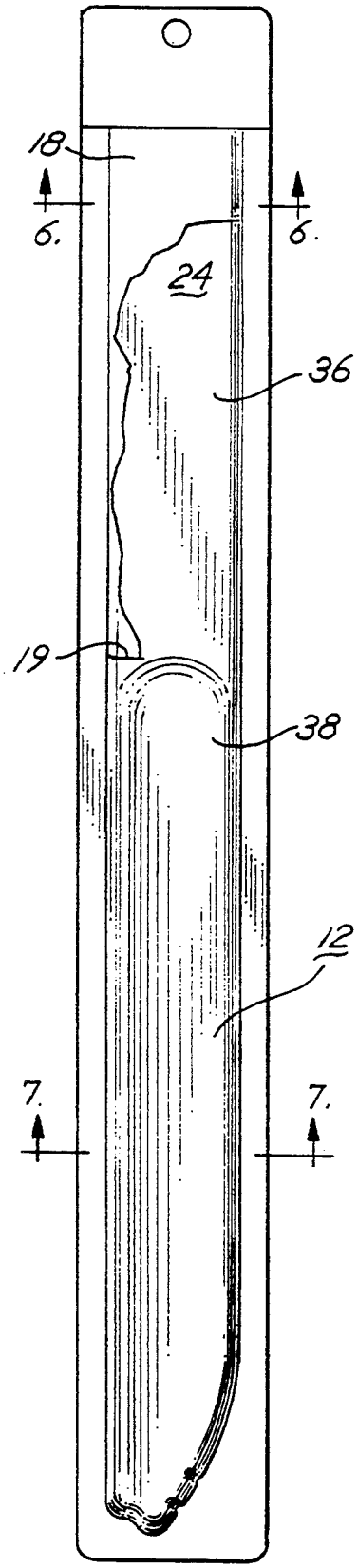
FIG. 5 is a front elevational view of the display container of FIG. 1 with the flap partially broken away to show the intersection of the flat and concave surfaces of the blister.
Figure 6:
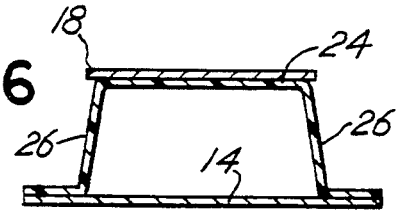
FIG. 6 is a cross-sectional view of the container of FIG. 5 along the lines 6—6.
Figure 7:
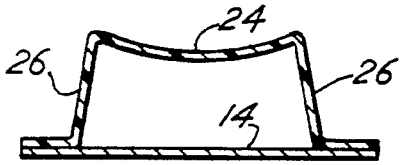
FIG. 7 is a cross-sectional view of the container of FIG. 5 along the lines 7—7.

Referring now to FIG. 5, the tongue 18 is shown partially broken away to show the front wall 24 of the blister 12. The front wall 24 has a flat region 36 lying directly below the tongue 18 so as to ensure contact between the front wall 24 and the adhesive portions 34 applied to the lower surface 32 of the tongue 18. The lower concave region 38 of the blister makes it easier for the user's fingertip to be inserted underneath the extreme bottom edge 19 of the tongue 18 to lift up the tongue 18. Cross-sectional views of the blister 12 along the lines 6—6 and 7—7 of FIG. 5 are found in FIGS. 6 and 7, respectively, further illustrating the flat and concave surface regions of the front wall 24.

Figure 8:
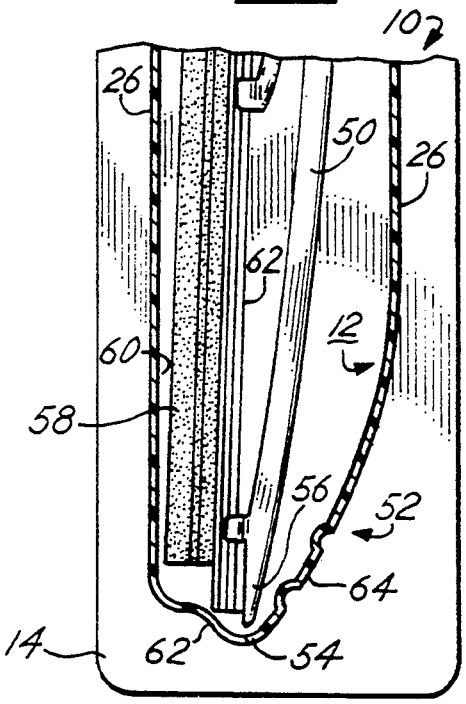
FIG. 8 is a cross-sectional, fragmentary view of the lower region of the blister of FIG. 7 along the lines 8—8 in which a windshield wiper assembly is placed within the blister, showing the recess structure which isolates the resilient wiping element 58 from the interior surface 60 of the blister.

Referring now to FIG. 8, the display container 10 of FIG. 1 includes a means for holding the resilient wiping element 58 of the windshield wiper assembly 50 away from the interior surface 60 of the blister 12. This prevents the resilient wiping element 58 from taking a set should the display container 10 and windshield wiper assembly 50 be stored for a prolonged period of time in a vertical orientation. As shown in FIG. 8, the blister 12 is shown as having a lower corner region 52, a concave wall 62 and a lateral edge wall 64. The intersection of the concave wall 62 and the lateral edge wall 64 creates a recess 54. The recess 54 is sized to accommodate the extreme lateral end 56 of the superstructure of the windshield wiper assembly 50. By accommodating the extreme lateral end 56 of the assembly 50 in the recess 54, and by positioning the recess 54 sufficiently far away from the interior surface 60 of the blister 12, the resilient wiping element 58 is prevented from being pressed into contact with the interior surface 60 of the blister 12. The dimensions of the concave wall 62 and lateral edge wall 64 will necessarily vary depending upon the particular dimensions and design of the extreme lateral end 56 of the wiper assembly 50, and the width of the wiping element 58 and the backing strip 62 for the wiping element 58. It is common in the art of windshield wiper design that the extreme lateral end portions 56 of the windshield wiper assembly 50 are either the metal superstructure of the assembly 50, or else the relatively stiff backing strip 62 for the wiping element 58. In either case, the recess 54 bears the weight of the windshield wiper assembly 50 and positions the assembly 50 such that the resilient wiping element 58 is prevented from pressing into the interior surfaces 60 of the blister 12.

Figure 9:
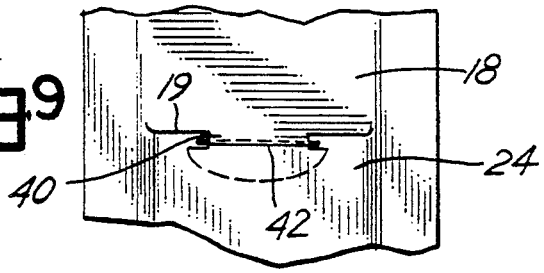
FIG. 9 is a fragmentary view of the container of FIG. 1 in which a tab is provided on the end of the tongue which engages a slot in the blister.

Referring now to FIG. 9, an alternative form of the tongue 18 of FIGS. 1–5 is shown wherein the tongue 18 is provided a tab 40 projecting downwardly from the extreme bottom edge 19 of the tongue. The tab 40 is inserted into a slot 42 provided in the front wall 24 of the blister 12. The tab 40 could of course be placed at other locations on the tongue 18 or blister closing portion 22 of the flap structure, the idea being that other types of closures between the flap structure and blister are possible and contemplated as being part of the invention.

Other variations and modifications to the preferred embodiments described herein are intended to be encompassed by the true spirit and scope of the invention. This true spirit and scope is defined by the appended claims to be interpreted in light of the foregoing specification.

We claim:

1. Apparatus comprising, in combination:

a windshield wiper assembly; and a recloseable display container for said windshield wiper assembly, said container comprising:

(a) a backing strip having a top portion;

(b) an elongate blister covering said backing strip, said blister containing said windshield wiper assembly, said blister comprising (i) a front wall having a flat upper portion and a lower portion, said lower portion having a concave recessed region separating said flat upper portion from said lower portion, (ii) first and second side walls, and (iii) an open top for receiving therethrough said windshield wiper assembly; and (c) a flap closing said open top of said blister, said flap comprising a header portion fixed to said top portion of said backing strip, a cover portion integral with said header portion covering said oven top of said blister, and an elongate tongue portion integral with said cover portion having a length substantially greater than the length of said cover portion, said elongate tongue portion covering said flat upper portion of said front wall, said tongue portion having a bottom portion releasably adhered to said flat upper portion of said front wall of said blister, said tongue portion and said cover portion of said flap foldable relative to said header portion to permit said windshield wiper assembly to be removed from and inserted into said display container without damage to said display container.

2. Apparatus as claimed in claim 1 wherein said flap comprises a unitary paper card.

3. Apparatus as claimed in claim 2 wherein said tongue portion has an upper surface and a lower surface and an extreme lower edge, and wherein an adhesive is applied to said flat upper portion of said front wall of said blister adjacent to said extreme lower edge of said tongue portion, releasably adhering said front wall of said blister to said lower surface of said tongue portion.

4. Apparatus as claimed in claim 1, wherein said windshield wiper assembly comprises a resilient wiping element and an extreme lateral end portion, and wherein said blister further comprises:

a means for receiving said extreme lateral end portion of said windshield wiper assembly and for holding said resilient wiping element a predetermined distance away from the interior surface of said blister when said display container is suspended in a vertical orientation, preventing said wiping element from taking a set during prolonged storage or display of said wiper assembly in a vertical orientation.

5. Apparatus as claimed in claim 4 wherein said blister further comprises a lower corner region and said means for receiving said extreme lateral end portion of said windshield wider assembly comprises a recess in said lower corner region receiving said extreme lateral end portion of said windshield wiper assembly.

6. Apparatus as claimed in claim 5 wherein said lower corner region further comprises a concave wall and a lateral edge wall, said recess comprising the intersection of said concave wall and said lateral edge wall.

7. Apparatus comprising, in combination:

a windshield wiper assembly having an extreme lateral end portion and a resilient wiping element; and a display container for said windshield wiper assembly comprising:

(i) a backing strip;

(ii) an elongate blister covering said backing strip, said blister containing said windshield wiper assembly, said blister having a lower portion; and (iii) a means for receiving said extreme lateral end portion of said windshield wiper assembly and for holding said resilient wiping element a predetermined distance away from the interior surface of said blister when said display container is suspended in a vertical orientation, preventing said wiping element from taking a set during prolonged storage or display of said wiper assembly in a vertical orientation.

8. Apparatus as claimed in claim 7 wherein said blister further comprises a corner region receiving said extreme lateral end portion of said windshield wiper assembly, said means for receiving said extreme lateral end portion of said wiper assembly comprising a recess in said lower corner region receiving said extreme lateral end portion of said windshield wiper assembly.

9. Apparatus as claimed in claim 8 wherein said lower corner region further comprises a concave wall and a lateral edge wall, said recess comprising the intersection of said concave wall and said lateral edge wall.

10. Apparatus comprising, in combination:

a windshield wiper assembly; and a recloseable display container for said windshield wiper assembly, said container comprising:

(a) a backing strip having a top portion;

(b) an elongate blister covering said backing strip, said blister containing said windshield wiper assembly, said blister comprising (i) an elongate front wall having an upper portion and a lower portion, said upper portion of said front wall having a predetermined width;

(ii) first and second side walls, and (iii) an open top for receiving therethrough said windshield wiper assembly; and (c) a flap closing said open top of said blister, said flap comprising a header portion fixed to said top portion of said backing strip, a cover portion integral with said header portion covering said open top of said blister, and an elongate tongue portion integral with said cover portion having a length substantially greater than the length of said cover portion, said elongate tongue portion covering said upper portion of said front wall, said elongate tongue portion having a predetermined length greater than said width of said upper portion of said front wall of said blister;

said elongate tongue portion releasably adhered to said upper portion of said front wall of said blister, said tongue portion and said cover portion of said flap foldable relative to said header portion to permit said windshield wiper assembly to be removed from and inserted into said display container without damage to said display container.

11. The apparatus of claim 10, wherein said elongate tongue portion has a predetermined width substantially equal to said width of said front wall of said blister.

12. The apparatus of claim 10 or claim 11, wherein said predetermined length of said elongate tongue portion is greater than two times said width of said upper portion of said front wall of said blister.

* * * * *